US006182965B1

(12) United States Patent
Escott et al.

(10) Patent No.: US 6,182,965 B1
(45) Date of Patent: Feb. 6, 2001

(54) RING-SPINNING GAMES WITH GAME PARTS AND METHODS OF PLAY

(76) Inventors: Charles R. Escott; Esther R. Escott, both of 179 Woodcrest Way, Grass Valley, CA (US) 95949

( * ) Notice: Under 35 U.S.C. 154(b), the term of this patent shall be extended for 0 days.

(21) Appl. No.: 09/188,121

(22) Filed: Nov. 9, 1998

Related U.S. Application Data

(60) Provisional application No. 60/065,809, filed on Nov. 14, 1997.

(51) Int. Cl.[7] ..... A63F 9/00

(52) U.S. Cl. ..... 273/236; 273/243; 273/273; 273/138.1; 473/588; 473/589

(58) Field of Search ..... 273/236, 138 R, 273/273, 147, 146, 288, 291, 243; 473/589, 588

(56) References Cited

U.S. PATENT DOCUMENTS

| | | | |
|---|---|---|---|
| 1,571,901 | 2/1926 | Monson | 273/147 |
| 1,587,127 | 6/1926 | Monson | 273/147 |
| 1,595,611 | 8/1926 | Monson | 273/147 |
| 1,610,530 | 12/1926 | Monson | 273/147 |
| 4,261,569 * | 4/1981 | Frohlich | 273/244.2 |
| 5,340,113 * | 8/1994 | Respicio | 273/249 |
| 5,462,282 * | 10/1995 | Romano | 273/240 |
| 5,480,150 * | 1/1996 | Weyand | 273/138 R |
| 5,524,896 | 6/1996 | Brotz | 273/241 |

* cited by examiner

*Primary Examiner*—Benjamin H. Layno
(74) *Attorney, Agent, or Firm*—Robert P. Bell

(57) ABSTRACT

A plurality of circular disks or rings, each disk or ring having a different color, number or other indicia affixed, printed or otherwise incorporated onto each of its two flat sides may be spun by hand to fall with one or the other of their two flat sides facing upward and showing the color, number or other indicia from which to determine score or playing action. Indicia on the disks or rings may be linked to other indicia, such as that on playing cards, game boards, pawns and the like, providing increased game complication. As an educational game, such linking of the ring indicia with external indicia may provide pre-game opportunities to select the level of difficulty. A plurality of such two-sided rings may provide combinations of the ring indicia, such as color combinations, and these combinations themselves may bring into play external indicia or may denote other playing action.

18 Claims, 5 Drawing Sheets

Figure 1
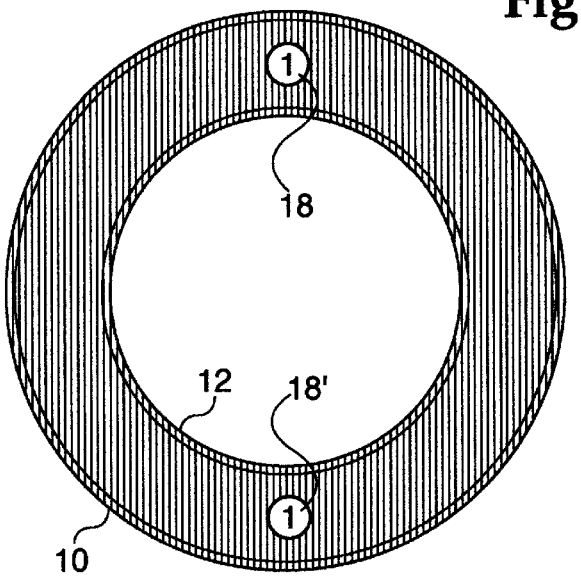
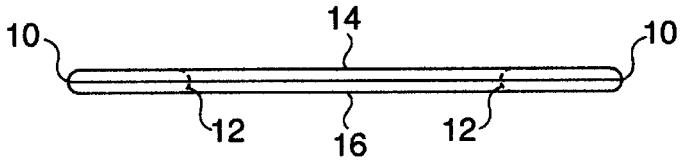
Figure 2
Figure 3
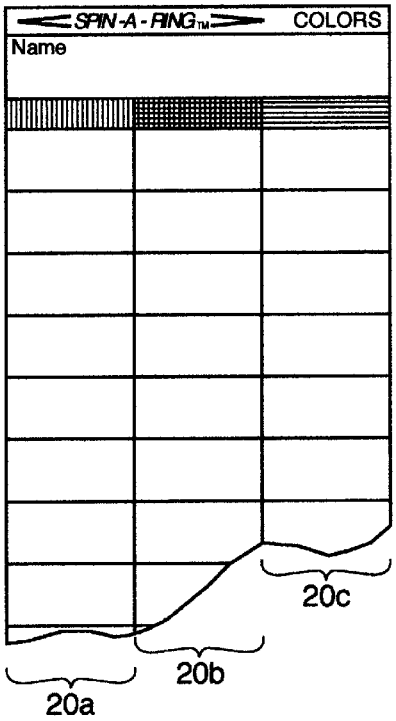

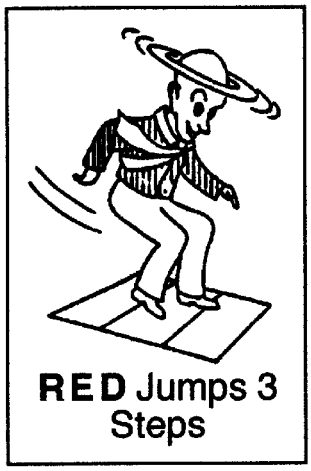
Figure 4
Figure 5
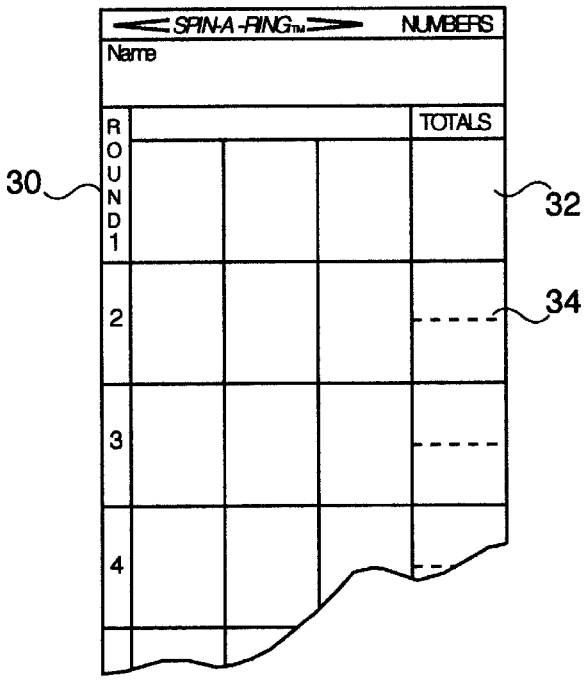
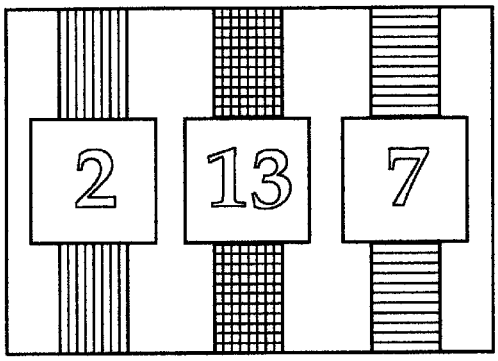
Figure 6

| | | |
|---|---|---|
| Take another player's unprotected pair and release in your wild. Or, take an animal card. | Take a special action card. | Place one of your unprotected pairs in Extinction; if you have none, take an animal card. |
| 3 | 4 | 5 |

SEVERE DROUGHT

All players move one pair from their Wild areas back into their Animal Shelters

RING-SPINNING GAMES WITH GAME PARTS AND METHODS OF PLAY

CROSS-REFERENCE TO RELATED APPLICATIONS

This application claims priority from Provisional U.S. patent application Ser. No. 60/065,809, filed Nov. 14, 1997, and incorporated herein by reference.

FIELD OF THE INVENTION

The present invention relates to games involving chance selection of colors, numbers and the like. More specifically, the present invention relates to games utilizing a plurality of circular disks or rings, each disk or ring having a different color, number or other indicia affixed, printed or otherwise incorporated onto each of its two flat sides and which disks or rings may be spun by hand to fall with one or the other of their two flat sides facing upward and showing the color, number or other indicia from which to determine score or playing action.

BACKGROUND OF THE INVENTION

A number of spinning toys are known in the prior art, such as tops, where the object is to keep the top rotating around its axis, and hula hoops, which spin concentrically around a person's body. Games of chance are also known where rolling or throwing dice and spinning wheels or pointers are used.

Monson, U.S. Pat. Nos. 1,571,901, 1,587,127, 1,595,611, and 1,610,530, issued Feb. 2, 1926, Jun. 1, 1926, Aug. 10, 1926, and Dec. 14, 1926, respectively, each describe a game of chance involving a disk which is held perpendicular to the base on which it rests and is spun by hand. This disk is thickest at its center with thinner edges, these edges being segmented into areas which provide resting places. As the disk drops, it comes to rest on a section of the disk which is marked with particular indicia. This disk depends on its own shape for a random selection of indicia.

Brotz, U.S. Pat. No. 5,524,896, issued Jun. 11, 1996, discloses a game of chance involving spinning a flat ring until it drops. The ring has a central aperture containing cross hairs through which, when the ring has fallen, the player observes indicia on the board underneath the cross hairs. Brotz does not teach or suggest placing indicia on the ring itself and using the position of the ring i.e., one side versus the other) as an indicator of the chance outcome.

SUMMARY OF THE INVENTION

The present invention utilizes a ring or rings which have flat sides displaying differing indicia on their fronts and backs. The ring or rings may be spun until they fall on one side or the other, with the upward side of each ring or rings indicating chance outcomes. The chance outcome of the spinning rings may be connected with playing cards or other sets of colors, numbers, and the like, thus offering both changeable ranges of difficulty and the increased complication and play value provided by such external indicia. When a plurality of spinning rings is used, additional combinations of chance outcomes may be produced, which combinations themselves may call into play external indicia and may also denote playing action.

It is an object of the present invention to provide games in which the players take turns spinning by hand a plurality of disks or rings on a surface, which disks or rings each have two flat sides, (i.e., a front and a back).

It is a further object of the present invention to provide games of chance in which the players spin disks or rings which have differing indicia on their two flat sides, so that there exists a 50/50 chance of either front or back indicia facing upward as the rings fall.

It is a still further object of the present invention to provide competitive ring-spinning games through keeping score from upward-facing colors, numbers or other indicia on the fallen disks or rings.

It is yet a further object of the present invention to provide ring-spinning games in which playing cards, playing boards or other sets of indicia may be brought into play by particular indicia displayed on the fallen disks or rings, these other sets of indicia providing pre-game opportunities to select range of difficulty and providing enhanced entertainment value.

It is a still further object of the present invention to provide ring-spinning games in which a plurality of the spinning rings may provide combinations of indicia among the fallen rings, combinations which may bring into play external indicia or which may denote playing action.

BRIEF DESCRIPTION OF THE DRAWINGS

FIG. 1 is a top view of a ring of the present invention as the ring lies flat, illustrating an embodiment where a set of numerals is placed at opposite points across the ring.

FIG. 2 is a side view of the edge of the ring in FIG. 1, illustrating a line horizontally crossing the center of the ring where the top and bottom halves adjoin, where the two halves may be of different colors.

FIG. 3 is a partial view of one embodiment of a score sheet or card which may be used in a game of the present invention, in which the colors displayed on the fallen rings are the primary indicia for keeping score.

FIG. 4 illustrates one embodiment of a playing card which may be used in a game of the present invention involving color as the scoring indicia, such cards being brought into play by a particular color or combination of colors on the fallen rings.

FIG. 5 illustrates a partial view of one embodiment of a score sheet or card which may be used in a game of the present invention in which the numbers on the fallen rings are the indicia for keeping score.

FIG. 6 illustrates one embodiment of a playing card which may be used in a game of the present invention involving numbers, these cards having been brought into play by a particular combination of numbers on the fallen rings.

DETAILED DESCRIPTION OF THE INVENTION

Figure 7:
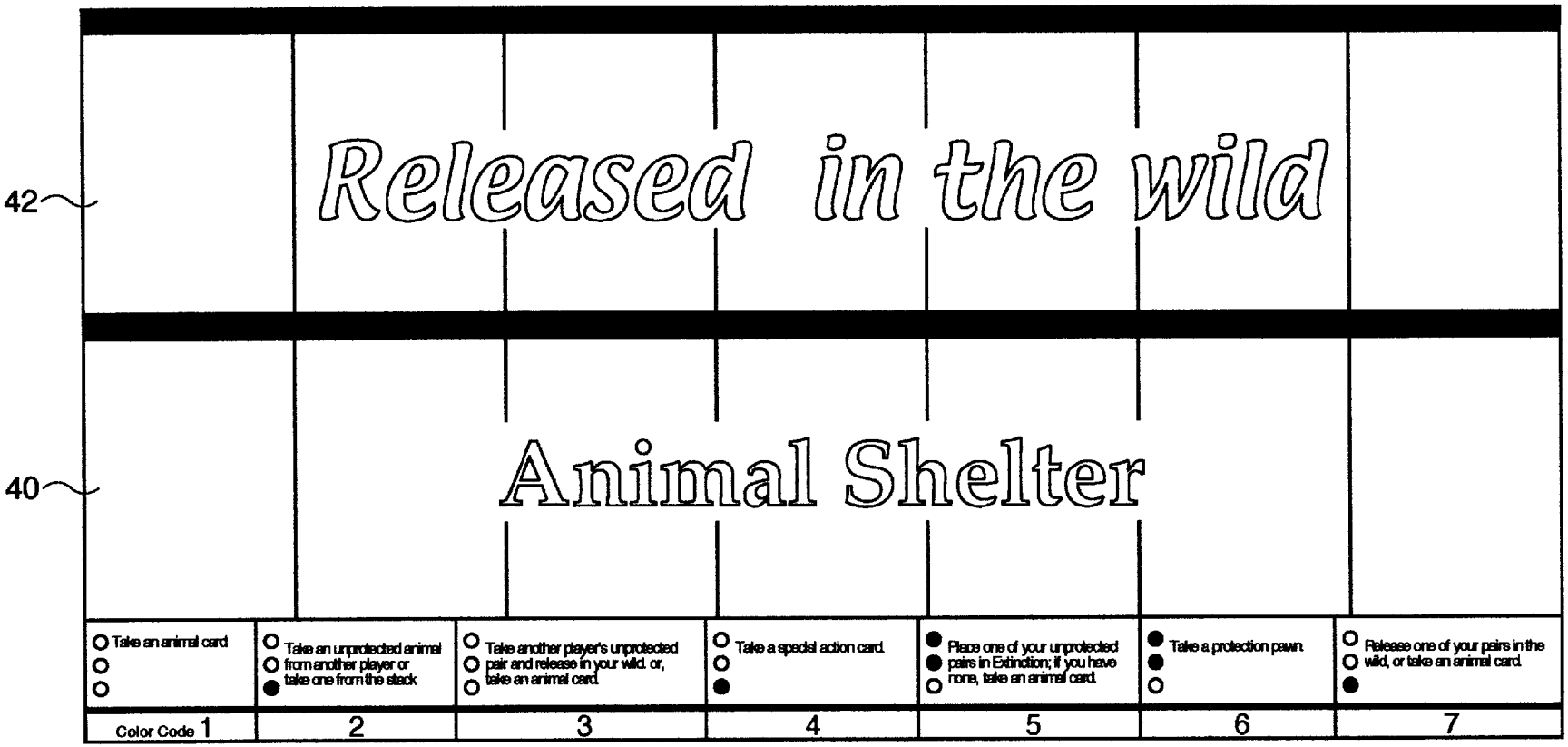
FIG. 7 illustrates one embodiment of a playing board which may be used in a game involving animals, on which board playing cards and pawns may be placed and moved, such action having been determined by particular colors or combinations of colors, numbers or other indicia on the fallen rings.

The games of the present invention utilize disks or rings, such as illustrated as FIG. 1. The disks or rings of FIG. 1 may be made of plastic, wood, cardboard or other material and may be shaped with two flat sides 14 and 16 as illustrated in FIG. 2. The disks or rings of FIG. 1 may also have a predetermined thickness, as illustrated in FIG. 2, and may be shaped with a convex outer edge 10 to facilitate prolonged spinning. Inside edge 12 may also have a convex shape, for aesthetics and for providing a pleasant hand grip.

The rings may have color, as indicated in FIG. 1 by shading. The rings FIG. 1 may, in addition to color, or as an alternative thereof, have numbers, letters, symbols, pictures or other indicia 18 and 18' printed or affixed on their flat sides 14 and 16. In the example of FIG. 1, such indicia 18 and 18'0 are placed at opposite points across the circle.

In the preferred embodiment, rings, such as illustrated in FIG. 1, may be used. However, a disc or other generally round device may be used in place of a ring. In addition, disc or ring need not be round in its entirety, but only at a point where spun. Moreover, other shapes may be utilized, without departing from the spirit and scope of the present invention, so long as they comprise two alternate sides and may be readily spun on a smooth, flat surface.

The games of the present invention may involve each player taking turns at spinning one or more disks or rings on to a preferably flat, level surface, such as concrete, linoleum or low-pile carpet. Spinning is performed by holding each disk or ring of FIG. 1 perpendicular to the surface on which it rests and twirling it between thumb and fingers. Rings may be spun individually, or may be spun together by placing multiple rings flat together and spinning them as a group. To count as a spin, each ring of FIG. 1 must rotate several times before dropping. After spinning, the rings FIG. 1 are left lying until all have fallen. Score or playing activity is denoted by indicia revealed on the upward-facing sides of the rings.

In a preferred embodiment, three rings of FIG. 1 are used, with each ring of FIG. 1 having a color and number on its back side 14 differing from the color and number on its front side 16. The arrangement of colors and numbers applied to the rings is as follows. A first ring may be colored and numbered red/1 on its front and yellow/2 on its back. A second ring may be colored and number yellow/2 on the front and blue/3 on the back. A third ring may be colored/numbered blue/3 on the front and red/1 on the back. Thus, a combination of three colors and three numbers is provided, with two colors/numbers per ring.

Spinning the three rings of FIG. 1 in the preferred embodiment may produce any one of seven different color combinations among the fallen rings as follows:

| # | Ring 1 | Ring 2 | Ring 3 |
|---|---|---|---|
| 1 | red | red | yellow |
| 2 | red | red | blue |
| 3 | yellow | yellow | red |
| 4 | yellow | yellow | blue |

-continued

| # | Ring 1 | Ring 2 | Ring 3 |
|---|---|---|---|
| 5 | blue | blue | red |
| 6 | blue | blue | yellow |
| 7 | red | yellow | blue |

Of course, other combinations of colors, numbers, and other indica may be used without departing from the spirit and scope of the present invention. By altering the number of rings, colors, and the like, different numbers of combinations may be produced, with different probabilities of outcomes, depending upon the arrangement of colors (or other indicia) and rings.

If playing a game in which colors are the scoring indicia, players may record their scores on any paper or on a scorecard such as illustrated in FIG. 3. Such a scorecard may contain columns of boxes 20*a*, 20*b* and 20*c*, each column marked with one of the ring colors. Players may make a mark, such a line or a dot, in boxes 20*a*, 20*b*, and 20*c*, for each corresponding color revealed on the rings after they have been spun during a player's turn. The first player to fill one color column 20*a*, 20*b* or 20*c* would win; or, for a longer game, the first player to fill the entire scorecard of FIG. 3 would be the winner.

To heighten player interest and provide further complication to the colors game, playing cards such as illustrated in FIG. 4 may be used. The playing cards may each show indicia such as, but not limited to, that illustrated on FIG. 4. The indicia on each playing card may show scoring information or further instructions for play.

Cards may be brought into play by a particular unique combination of colors revealed on the fallen rings. For example, in the preferred embodiment, the colors combination may be red, yellow and blue. As noted above, this unique combination is one of seven possible outcomes in the preferred embodiment. Thus, if a player spins any of the other six combinations of colors, the player scores the colors as before. However, if the player spins a combination of red, yellow, and blue (combination number 7, above), the player may then draw a card.

The player spinning one of each color would take a playing card such as in FIG. 4 and follow its instructions. For example, if the player took the particular card of FIG. 4, the player would mark on the scorecard of FIG. 3 three boxes in the red column 20*a*. The playing card FIG. 4 would then be placed on the bottom of the card stack, and ensuing players would resume keeping score from the colors on the fallen rings. Alternately, the player may mark the scorecard for each of the three colors in the combination and follow the instructions in the card of FIG. 4.

Note that other instructions than that shown in FIG. 4 may be used. Moreover, instructions may be penalizing as well as rewarding a player. Thus, instructions such as "skip a turn", "reverse direction of play", or even "jump back" (i.e., lose a point in a particular column) may be used. Alternately, instructions may allow a player adjacent to the playing player to score (i.e., "player to the left jumps RED three steps"). Many other combinations of such instructions may be used within the spirit and scope of the present invention.

In another embodiment of a game employing numbers, players may record their numerical scores on any paper or on scorecards such as that depicted in FIG. 5. The scorecard of FIG. 5 shows the scoring area divided into rounds 30, a round consisting of all players having had a turn at spinning.

In each round 30, the player may record the score of each of the three fallen rings of FIG. 1, and total these three scores in the total square 32. Total squares starting with the second row, 34, are divided in half horizontally, affording the top half for that round's total and the bottom half for the sum of that round's total with the previous total in square 32 (or preceding total square 34), thus keeping a running score. The first player to reach a predetermined score, or the player with the highest score after a predetermined number of rounds may be declared the winner.

To increase complication and play value in such a numbers game, playing cards such as illustrated in FIG. 6 may be used. Such cards may be brought into play by the player having spun a particular combination of numbers on the fallen rings of FIG. 1, such as one of each number, in the example illustrated, numbers 1, 2 and 3 (and, correspondingly, one of each color, red, yellow and blue). In this instance, the player would take the top playing card, such as illustrated in the example of FIG. 6, from the stack. This card, FIG. 6, shows three numbers, one red, one yellow, and one blue. Each number on the playing card changes the numerical score value of the corresponding ring of the matching color.

In the example illustrated in FIG. 6, the red ring would now have a score value of 2, the yellow ring a score value of 13, and the blue ring a score value of 7. The player, having just spun one red, one yellow and one blue, would record the scores 2, 13 and 7, for a total score of 22. The new numerical values for the rings FIG. 1 would apply for all ensuing players, until a player again spun one ring of each color, and took another playing card, thereby changing the numerical values of the rings again. Thus, in this embodiment, the rings FIG. 1 would have constantly changing numerical values.

Other rules may be applied using the playing card of FIG. 6. For example, the card values may be applied to only the player drawing the card, and not other players. Further, as in the color game, the card values may be punitive as well as rewarding to the player. For example, values lower than the ring face values may be displayed on the card, or even negative values. Similarly, other instructions, such a "change direction of play", "lose turn", "skip next player", and the like, may be used. Moreover, score values may be assigned to an adjacent player, as indicated by instructions on the face of the card. All such variations, as well as other types of instructions, fall within the spirit and scope of the present invention.

The use of indicia external to that on the rings FIG. 1, such as playing cards, charts, or other sets of indicia, and linking such external indicia to a particular combination of fallen rings, provides opportunities to change the level of difficulty of educational games by selecting certain external indicia for play. For example, in the numbers game described herein, a parent or teacher could select playing cards having only single digit numbers, or double or triple digit numbers, or fractions, decimals, or mixed numbers, for educational purposes and the like.

Figure 11:
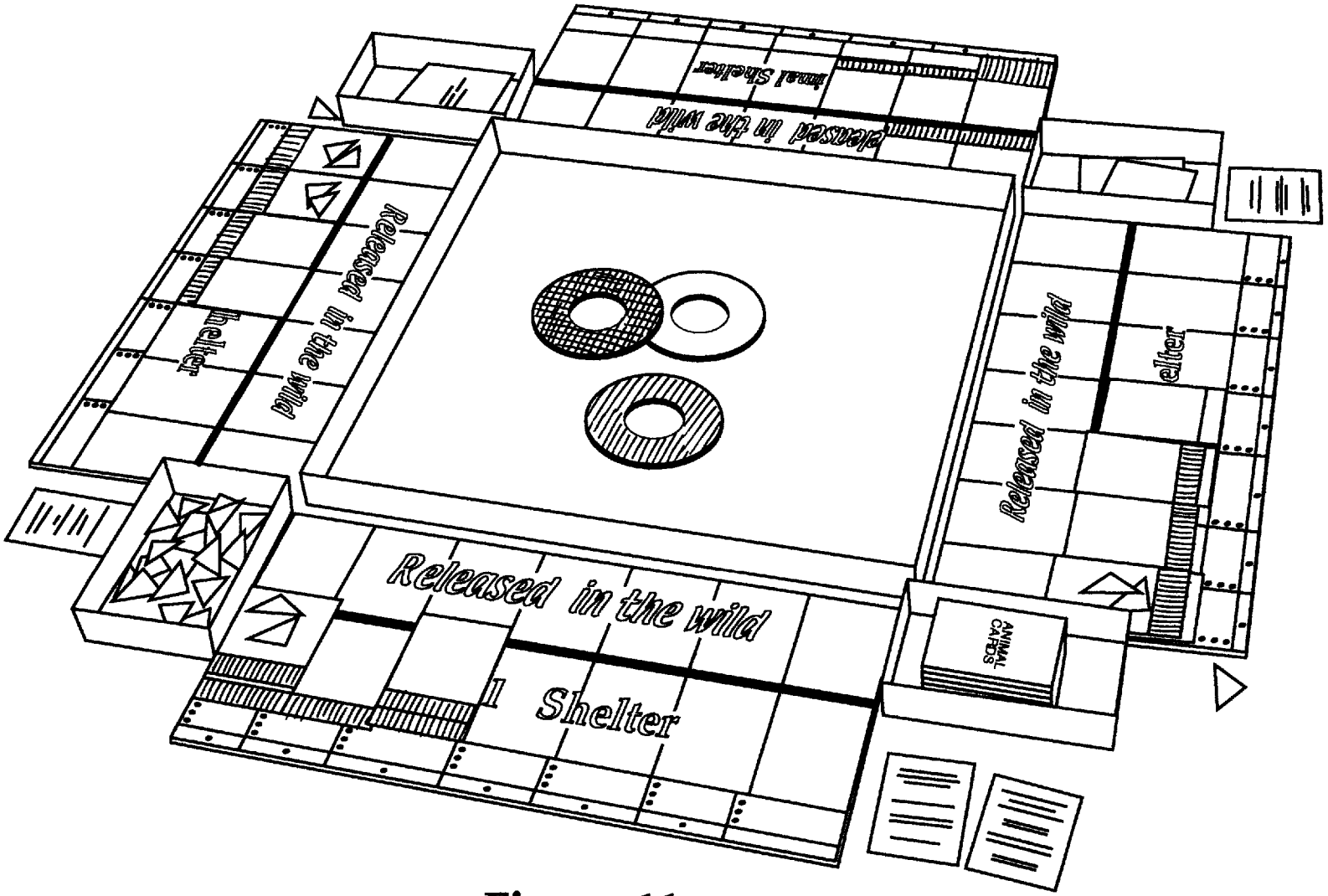
FIG. 11 is a perspective view of the playing surface and boards of the game of FIG. 7, illustrating game in play.

Another embodiment of the present invention involves animals. In this embodiment playing boards may be used, such as but not limited to the individual player's board FIG. 7. An arrangement of such playing boards is shown as a perspective view in FIG. 11, illustrating game in play. In such a game, animal cards, such as illustrated in the example of FIG. 9, may be collected, paired, and placed in a slot in each player's animal Shelter 40 and from there gradually moved to the player's Released in the Wild area 42, where they may be counted for score. The Appendix, attached hereto, contains an exemplary set of rules for such an animal game.

In the animal game embodiment, the animal cards exemplified by FIG. 9 may also be taken by other players, or relegated to Extinction. Protection pawns may be used which, laid on animal pairs in a shelter 40, protect the pair from Extinction and from being taken by other players. Particular moves may be required by special action cards, exemplified by the card of FIG. 10, which may affect only the card holder or other players as well. All playing action in this game is determined by spinning three two-sided, colored rings as in FIG. 1 and thus producing the seven aforementioned color combinations.

Figures 8, 9, 10:
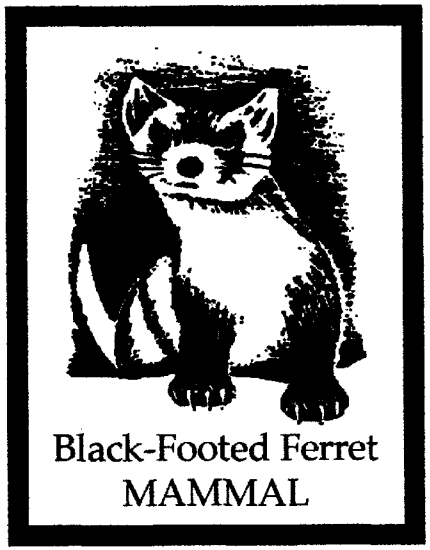
FIG. 8 illustrates a detail from the playing board illustrated in FIG. 7, showing one possible format or arrangement by which combinations of colors on the fallen rings may denote playing action.
FIG. 9 illustrates one embodiment of a playing card which may be used in a game involving animals, such cards being brought into play by particular combinations of colors or other indicia on the fallen rings.
FIG. 10 illustrates another type of playing card which may be used in a game involving animals, such a card giving instructions for play activity and having been brought into use by a particular combination of colors or other indicia on the fallen rings.

In the animal game embodiment, each color combination may denote a particular play action, as illustrated in FIG. 8, which is a detail of each player's individual playing board FIG. 7. For each of the seven color combinations (or, in the alternative, a sum or combination of numbers, or combination of indicia), one or more actions may be prescribed. For example, as illustrated in FIG. 8, combination 3 may include the instructions to take another player's unprotected pair and release into your own wild section, or draw another animal card. Combination 4 may instruct the player to take a special action card (as exemplified in FIG. 10) and follow the instructions thereon. Combination 5 may instruct the player to place an unprotected pair of animal cards in the extinction section, or, if no unprotected pairs are available, take an animal card.

Other instructions may be provided within the spirit and scope of the present invention. In the preferred embodiment, as illustrated in FIG. 1, the instructions may be as follows:

Instruction
1 Take an animal card
2 Take an unpaired animal from another player or take one from the stack
3 Take another player's unprotected pair and release into your own wild section. Or draw another animal card.
4 Take a special action card
5 Place an unprotected pair of your animal cards in the extinction section; if you have none, take an animal card.
6 Take a protection pawn.
7 Release one of your pairs in the Wild, or take an animal card.

The above illustrations are intended to explain the use of the previously-described spinning disks or rings and the linking of ring indicia such as but not limited to colors, numbers, and combinations of these with other indicia such as but not limited to playing cards, playing boards, pawns and scorecards. Two particular ring-spinning games have been herein described, the first involving colors and/or numbers, the second game involving animals.

It should be recognized that these games have in common the chance selection of and play activity denoted by indicia or combinations of indicia achieved by spinning a plurality of two-sided disks or rings. Similar chance selections or combinations may be obtained by shaking or throwing disks, rings or dice, by spinning wheels or pointers, or by other chance selection devices.

For example, disks or rings FIG. 1 may be of varying sizes and made of various materials. More rings may be provided in a game, such as six, with players choosing how many and which rings to use. Indicia on these rings may change, as may sets of external indicia tied to the rings by a particular combination of fallen rings. Sets of external indicia may include maps, charts or sets of indicia other than or in addition to playing cards, playing boards and scorecards.

Much variety in the rules may exist with regard to scoring, for example. In certain rounds of play, the totals may be subtracted from the previous total, creating the possibility of negative scores. Numbers on playing cards could be multiplied by the numbers on the rings. In addition, math functions of addition, subtraction, multiplication, and division could be involved by altering the ring indicia and the associated external indicia.

Other board games are foreseen employing spinning disks or rings which display differing indicia on their fronts and backs and which rings are associated with external indicia. Also foreseen are comparable computer games, where spinning of rings may be simulated or even animated (e.g., using 2-D or 3-D graphics).

In the animal game, scoring may be modified by providing different scores for different types of animals, depending upon rarity. Thus, for example, white tiger may score 50 points as a matched pair in the wild, while tree squirrel scores 1 point for a matched pair in the wild.

While the preferred embodiment and various alternative embodiments of the invention have been disclosed and described in detail herein, it may be apparent to those skilled in the art that various changes in form and detail may be made therein without departing from the spirit and scope thereof.

APPENDIX

WILDLIFE

Instructions for Play

1. Two to four persons can play. Place an "Animal Shelter" board before each player. Shuffle the Animal Cards and Special Action Cards and place face-down in their boxes. Place Protection Pawns in their box. Place the game box lid in the center of the table, and the four small boxes, including "Extinction," outside the box lid corners.
2. Players each take 4 Animal Cards from the top of the stack and place them in their Animal Shelters, in the delineated areas. All cards collected are kept face-up.
3. Players spin all 3 rings by twirling them between thumb and fingers inside the box lid, letting the rings lie until all have fallen. (To count as a spin, each ring must rotate several times.) The first person to spin one of each color plays first.
4. Each player notes the colors on his fallen rings, locates his set of colors in the Color Codes printed across the bottom of his Animal Shelter, and takes the stated action.
5. Players collect animal Cards in their Shelters, gradually forming pairs. Each pair is stacked staggered for clear visibility to all players. The goal for all players is to move pairs from their Animal Shelters up into the area marked Released in the Wild.
6. When Special Action Cards are take, Code 4, they can be used at once or kept until they become most useful. (However, if they are kept until the game ends, they count against the holder.) After use, they are placed face-down at the bottom of the stack. Later use of a Special Action card constitutes the player's turn.
7. Players spinning Code 6 take a Protection Pawn. Two Pawns, laid on an animal pair in a player's Shelter, protect the pair from being taken by another player. They also protect the pair from Extinction. A pair with fewer than two pawns is considered unprotected. When a player forms a new pair, he may place pawns after taking the Color Code action on his next turn. Thereafter, he may place pawns at any time or may switch pawns between pairs.
8. As Animal pairs are moved into the Wild, into Extinction, or onto another player's board, any pawns on them are returned to the Pawn Bank.
9. Players may trade single animal cards and protection pawns with any other willing player: card for pawn, pawn for card, or card for card. For the player requesting the trade, the trade constitutes his turn.
10. The game ends when all the Animal Cards have been used up. For an optional longer game, at this point collect all player's unpaired animals, shuffle them to form a new stack, and continue playing until all animals have been paired. (Players' single animals may have to be collected and restacked more than once.)
11. Highest score wins! Pairs in the Wild count 10 points each pair; Matching Pairs in the Wild, (i.e., two pairs of Pandas,) 20 points each pair; Protected Pairs in Shelters, 3 points; Unprotected Pairs, 2 points; unused Special Action Cards, minus 15 points. Ties: take turns spinning the rings; the first to spin a Code 7 wins. Note—high scores can be attained by strategic trading and use of Special Action Cards.

We claim:

1. A method of playing a game of chance, wherein at least two players take consecutive turns, each consecutive turn comprising the steps of:

spinning one or more playing pieces, each playing piece having two opposite sides, allowing the one or more playing pieces to each land on one of two opposite sides after each of the one or more playing pieces has stopped spinning, and recording, in a table provided for each corresponding player, a tabulation of which side of the one or more playing pieces faces upwards after each playing piece has stopped spinning, the table being provided with a plurality of columns, each indicating which side faces upwards after each playing piece has stopped spinning, each column being provided with a predetermined number of rows for recording outcomes of individual turns, wherein a player wins the game of chance when the player has completed one column in the table provided for each corresponding player.

2. The method of claim 1, wherein the one or more playing pieces are colored on each of opposite sides, each of the opposite sides of each playing piece being a different color from the opposite side of the same playing piece, wherein said step of recording further comprises the step of:

recording, in a table provided for each corresponding player, a tabulation of which color each of the one or more playing pieces faces upwards after each playing piece has stopped spinning, the table being provided with a plurality of columns, each indicating a color, each column being provided with a predetermined number of rows for recording outcomes of individual turns.

3. The method of claim 2, wherein each consecutive turn further comprises the steps of:

drawing a card from a deck of cards, each card printed with a set of instructions, if a combination of colors of a side of each of the one or more playing pieces facing upwards after each playing piece has stopped spinning is a predetermined combination of colors, and altering score in a table provided for a player according to instructions printed on the card.

4. A method of playing a game of chance, wherein at least two players take consecutive turns, each consecutive turn comprising the steps of:

spinning one or more playing pieces, each playing piece having two opposite sides, the one or more playing pieces are numbered on each of opposite sides, each of the opposite sides of each playing piece having a different number from the opposite side of the same playing piece, allowing the one or more playing pieces to each land on one of two opposite sides after each of the one or more playing pieces has stopped spinning, and recording, in a table provided for each corresponding player, a tabulation of which number on each of the one or more playing pieces faces upwards after each playing piece has stopped spinning, the table being provided with a plurality of columns, one column for each playing piece, and another column for the total of the numbers on all of the playing pieces, each column being provided with a predetermined number of rows for recording numbers on individual playing pieces during individual turns.

5. The method of claim 4, wherein a player wins the game of chance when a sum of the total of the numbers on all playing pieces for that player is greater than or equal to a predetermined number.

6. The method of claim 4, wherein a player wins the game of chance when, after a predetermined number of consecutive turns, a sum of the total of the numbers on all playing pieces for that player is greater than any of sums of the total of the numbers on all playing pieces for any other respective player.

7. The method of claim 4, wherein each consecutive turn further comprises the steps of:

drawing a card from a deck of cards, each card printed with a set of numbers, each number corresponding to one of the one or more playing pieces, if a combination of numbers on sides of each of the one or more playing pieces facing upwards after each playing piece has stopped spinning is a predetermined combination of numbers, and recording, in the table provided for a corresponding player, the set of numbers from the card in one of the predetermined number of rows.

8. The method of claim 7 wherein the number on the card is used as a scoring number for a corresponding side of a playing piece in subsequent consecutive turns.

9. A method of playing a game, wherein at least two players take consecutive turns, each consecutive turn comprising the steps of:

spinning a plurality of playing pieces, each playing piece having two opposite sides and a peripheral edge, the playing piece being intentionally spun by the player on the peripheral edge on a flat surface and subsequently released by the player, allowing the plurality of playing pieces to each land on one of the two opposite sides after each of the plurality of playing pieces has stopped spinning, determining a combination of which side each of the plurality of playing pieces faces upwards after each playing piece has stopped spinning, and looking up the combination in a predetermined table to perform a particular action corresponding to the combination.

10. The method of claim 9, wherein the particular action comprises drawing a card from a first deck of cards, each card imprinted with an indicia.

11. A method of playing a game, wherein at least two players take consecutive turns, each consecutive turn comprising the steps of:

providing a deck of cards comprising a plurality of matched pairs of cards, spinning a plurality of playing pieces, each playing piece having two opposite sides, allowing the plurality of playing pieces to each land on one of two opposite sides after each of the plurality of playing pieces has stopped spinning, and determining a combination of which side each of the plurality of playing pieces faces upwards after each playing piece has stopped spinning, and looking up the combination in a predetermined table to perform a particular action corresponding to the combination, wherein the particular action comprises selectively taking an unpaired card from another player or taking a card from the first deck of cards.

12. A method of playing a game, wherein at least two players take consecutive turns, each consecutive turn comprising the steps of:

providing a deck of cards comprising a plurality of matched pairs of cards, spinning a plurality of playing pieces, each playing piece having two opposite sides, allowing the plurality of playing pieces to each land on one of two opposite sides after each of the plurality of playing pieces has stopped spinning, and determining a combination of which side each of the plurality of playing pieces faces upwards after each playing piece has stopped spinning, and looking up the combination in a predetermined table to perform a particular action corresponding to the combination, wherein the particular action comprises selectively taking a matched pair of cards from another player or taking a card from the deck of cards.

13. A method of playing a game, wherein at least two players take consecutive turns, each consecutive turn comprising the steps of:

spinning a plurality of playing pieces, each playing piece having two opposite sides, allowing the plurality of playing pieces to each land on one of two opposite sides after each of the plurality of playing pieces has stopped spinning, and determining a combination of which side each of the plurality of playing pieces faces upwards after each playing piece has stopped spinning, and looking up the combination in a predetermined table to perform a particular action corresponding to the combination, wherein the particular action comprises taking a card from a second deck of cards, each card of the deck of cards being imprinted thereon with a further instruction.

14. A method of playing a game, wherein at least two players take consecutive turns, each consecutive turn comprising the steps of:

providing a deck of cards comprising a plurality of matched pairs of cards, spinning a plurality of playing pieces, each playing piece having two opposite sides, allowing the plurality of playing pieces to each land on one of two opposite sides after each of the plurality of playing pieces has stopped spinning, and determining a combination of which side each of the plurality of playing pieces faces upwards after each playing piece has stopped spinning, and looking up the combination in a predetermined table to perform a particular action corresponding to the combination, wherein the particular action comprises placing a matched pair of cards in a discard pile, or, if the player has no matched pair of cards, taking a card from the deck of cards.

15. A method of playing a game, wherein at least two players take consecutive turns, each consecutive turn comprising the steps of:

providing a deck of cards comprising a plurality of matched pairs of cards, spinning a plurality of playing pieces, each playing piece having two opposite sides, allowing the plurality of playing pieces to each land on one of two opposite sides after each of the plurality of playing pieces has stopped spinning, and determining a combination of which side each of the plurality of playing pieces faces upwards after each playing piece has stopped spinning, and looking up the combination in a predetermined table to perform a particular action corresponding to the combination, wherein the particular action comprises taking a protection indicia from a group of protection indicia, wherein a pair of protection indicia may be placed on a matched pair of cards so as to prevent the matched pair of cards from being taken by another player, or in response to an instruction.

16. A method of playing a game, wherein at least two players take consecutive turns. each consecutive turn comprising the steps of:

providing a deck of cards comprising a plurality of matched pairs of cards, spinning a plurality of playing pieces, each playing piece having two opposite sides, allowing the plurality of playing pieces to each land on one of two opposite sides after each of the plurality of playing pieces has stopped spinning, and determining a combination of which side each of the plurality of playing pieces faces upwards after each playing piece has stopped spinning, and looking up the combination in a predetermined table to perform a particular action corresponding to the combination, wherein the particular action comprises selectively moving a matched pair of cards from a first portion of a playing board where they may be taken by another player in response to an instruction to a second portion of a playing board where they count for score, or taking a card from the deck of cards.

17. The method of claim 16, wherein the game ends when all of the first deck of cards have been drawn and the winning player is determined by the player having the most number of matched pairs of cards in the second portion of the playing board.

18. The method of claim 16, wherein the game ends when all possible matched pairs of cards have been made, and the winning player is determined by the player having the most number of matched pairs of cards in the second portion of the playing board.

* * * * *